United States Patent [19]

Daniel et al.

[11] Patent Number: 4,790,155

[45] Date of Patent: Dec. 13, 1988

[54] REPLACEABLE FLUID DYE APPLICATOR FOR INERT-BLANKETED REGIONS

[75] Inventors: Vernon T. Daniel, Oak Ridge; Jessie Gettliffe, Greensboro, both of N.C.

[73] Assignee: Burlington Industries, Inc., Greensboro, N.C.

[21] Appl. No.: 932,020

[22] Filed: Nov. 18, 1986

[51] Int. Cl.[4] ..... D06B 1/02

[52] U.S. Cl. ..... 68/205 R; 68/5 C; 68/5 D; 68/5 E; 68/6; 118/326; 118/678; 239/288.5

[58] Field of Search ..... 68/205 R, 5 C, 5 D, 68/5 E, 6; 118/300, 326, 678; 239/288.5, 288.3, 288; 134/122 R, 172, 175, 180, 183

[56] References Cited

U.S. PATENT DOCUMENTS

| | | | |
|---|---|---|---|
| 70,658 | 11/1867 | Webster | 68/6 |
| 1,529,134 | 3/1925 | Kelter | 118/326 X |
| 1,571,930 | 2/1926 | Ceasar | 68/6 |
| 2,915,889 | 12/1959 | Ethridge | 68/205 R X |
| 2,980,120 | 4/1961 | Jacobs | 134/183 X |
| 4,060,382 | 11/1977 | Vertegaal | 68/5 D |
| 4,254,644 | 3/1981 | Bartlett et al. | 68/205 R |

*Primary Examiner*—Harvey C. Hornsby

*Assistant Examiner*—Frankie L. Stinson

*Attorney, Agent, or Firm*—Nixon & Vanderhye

[57] ABSTRACT

A fluid nozzle assembly is disclosed for dispensing liquid dye onto an underlying fabric in a substantially closed structure provided with an inert gas atmosphere. The assembly includes an elongated rotatable housing provided along its length with a relatively narrow opening or slot. An elongated manifold, provided with a plurality of laterally spaced dispensing nozzles, is concentrically mounted within the housing so that the nozzles are aligned with the slot. The housing and manifold are rotatable from a first operative position where the nozzles are in communication with the interior of the structure, to a second inoperative position where the nozzles are substantially isolated from the interior of the structure so that the nozzles may be removed for maintenance, cleaning or replacement without significant loss of inert gas from the interior of the structure. In an alternative embodiment, a fixed, cylindrical housing is mounted exteriorly and concentrically with respect to the rotatable housing and, when the rotatable housing is rotated to an inoperative position, the manifold may be slidably removed through an end wall of the fixed housing.

22 Claims, 2 Drawing Sheets

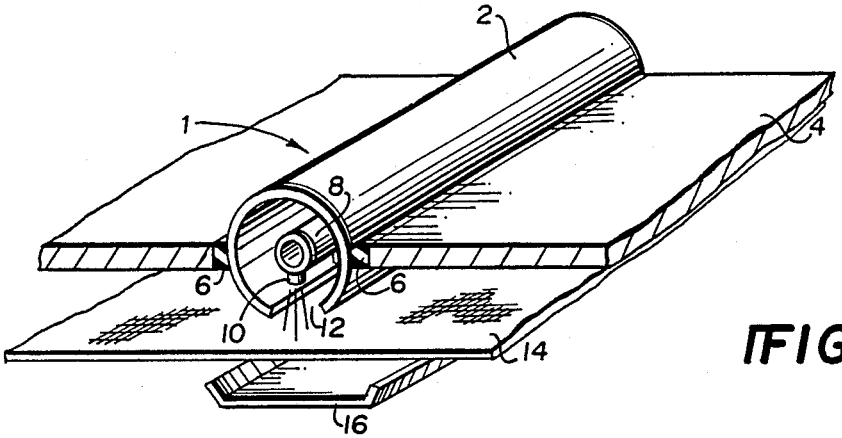
FIG. 1
FIG. 2
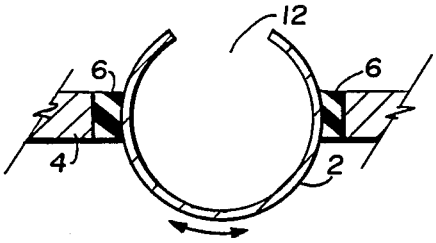
FIG. 3
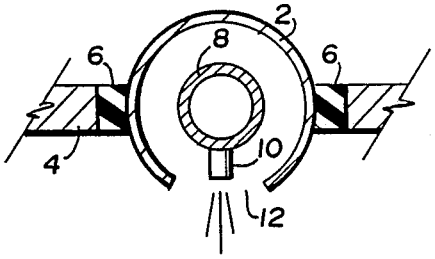
FIG. 4
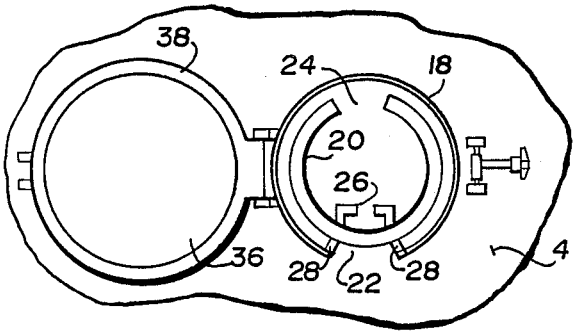
FIG. 5
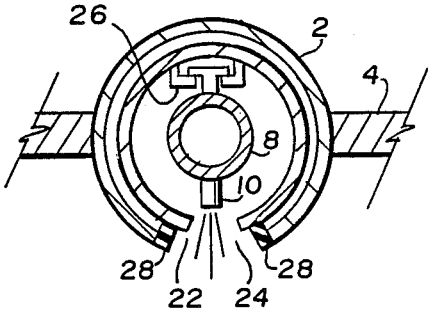
FIG. 6
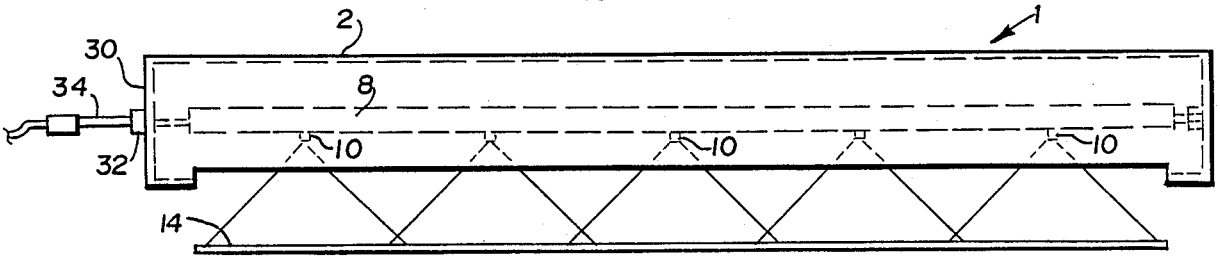

REPLACEABLE FLUID DYE APPLICATOR FOR INERT-BLANKETED REGIONS

This invention relates to an apparatus for applying dyeing compositions to a fabric in open width in a substantially closed structure. More specifically, it relates to a fluid nozzle assembly for spraying a high-boiling, nonionic solvent dyeing composition onto a moving fabric while the fabric is maintained in an inert atmosphere. The fluid nozzle assembly applies the dyeing composition in a generally uniform manner, and is part of a tenter frame or other textile processing equipment in which the fabric and the sprayed dyeing composition are maintained in an inert environment.

BACKGROUND OF THE INVENTION

Color is imparted to textile articles by various procedures. One well-known procedure is using a high-boiling, nonionic solvent as a solvent or carrier for a dyestuff, and once applied to the fabric or textile article, heating the article to a temperature sufficient to introduce the dyestuff into the textile fibers and to fix the dyestuff in the fibers. Organic compounds capable of withstanding elevated temperatures and suited for this type of process are generally characterized as high-boiling, nonionic solvents to the extent that they solubilize or facilitate the solubilization of the dyestuff or mixtures of dyestuffs being used for the dyeing operation. In some instances, these materials have been referred to as non-aqueous, high-boiling, nonionic solvents. Illustrative of this type of solvent dyeing system are U.S. Pat. Nos. 4,115,054 to Hermes and 4,293,305 to Wilson, among others. The Wilson patent describes selected aromatic esters and cycloaliphatic diesters useful in a non-aqueous or substantially non-aqueous system including a solvent and a dyestuff and, if necessary, further additives.

While this type of solvent dyeing is extremely effective, the organic solvents used are costly and, for maximum economy, must be recycled for additional use. Further, it has been reported that inert environments serve to extend the useful life of these organic solvents, and thus a preferred manner of practicing the dyeing process is to do so in an inert atmosphere such as an atmosphere of nitrogen, Freon or other inert gas; see the published European applications of Pensa et al, EPO No. 1 159 876 and EPO No. 1 159 877.

Another patent document extolling the virtues of operating a solvent dyeing process using a high-boiling, nonionic solvent dyeing system in a non-reactive environment is U.S. Pat. No. 4,550,579 to Clifford. In this patent, the organic solvent/dyestuff dyeing composition is applied as a flowing film, termed a "microbath", so that the article being dyed is in constant contact with the dye composition. The procedure is conducted in an atmosphere that is not reactive with the organic solvent. The atmosphere is defined as any composition that can be maintained as a stable gas at the temperature of dyeing without reacting with the dye composition or textile material and that will displace air and with it oxygen surrounding the article or fabric to be dyed. Fluorocarbon solvents are preferred.

Other dyeing systems operating in a closed environment are described in U.S. Pat. No. 3,698,855 in which the flat goods to be dyed are maintained on a shelf in a closed chamber, steam is injected into the chamber and a pressurized dye liquid is sprayed onto and recirculated over the flat goods to be dyed. Similar arrangements are described in U.S. Pat. No. 3,271,102 to Morgan and U.S. Pat. No. 3,868,835 to Todd-Reeve.

None of these prior arrangements take into account the possibility of processing time sacrificed or loss of controlled environment should it become necessary to change the manner in which the dye-containing composition is applied to the textile article to be dyed. As examples, for goods dyed as a flat fabric, it may be necessary during the course of the dyeing operation to change the width of the goods and/or to change the color that the fabric is to be dyed. Particularly operating with the high-boiling, nonionic solvents, when changing from one color to the other, the operator will also use a different organic liquid in which a different color of dyestuff is dispersed. Because the dyeing operation is conducted at elevated temperatures, ranging from 350° F. to as much as 450° F., an attractive area in which to both apply the dye and to heat fix it to the fabric is a tenter oven. In commercial practice, these tenter ovens are of considerable size and expense, often ranging from 2 to 15 feet in width and an overall length often in excess of 100 feet. Providing a non-reactive environment to such a large piece of equipment is not only an engineering challenge, but an economic challenge as well. Supporting equipment to recover, condense and recirculate the non-reactive medium, as well as a source of additional make-up non-reactive medium, are required. Since the process may be designed to run in a continuous manner, any disruptions in the continuity of operation are costly, with respect to loss of goods being dyed. Also, when the non-reactive environment is considered, there is the expense of losing substantial quantities of the gas that is used to provide the non reactive environment. Thus, brief shut-downs for relatively minor adjustments on such equipment operated under atmospheric conditions become extremely expensive and time consuming when the equipment is operated so as to provide a non-reactive environment for the fabric being treated.

In addition to preferring a non-reactive environment for solvent dyeing using the high-boiling, nonionic solvent-based dyeing compositions, there is also a clear preference in the art to apply these compositions as a cascade, as a flowing curtain or as a thin film as opposed to simply spraying the compositions onto the goods to be dyed. Indeed, the Clifford patent, referred to above, describes at some length the disadvantages of using a spray or shower to apply the dye composition onto the textile article to be dyed. As examples, it is pointed out in this patent that a spray or shower applies the dye liquid to the textile article in the form of droplets or fine particles and this exposes the largest liquid surface to the surrounding ambient atmosphere. This means that the entire article is not in constant contact with the dye composition throughout the dyeing step, according to Clifford. There is also the possibility for significant heat loss as the droplets pass through the surrounding atmosphere before contacting the shaped article.

Despite such worrisome warnings and concerns, we have discovered and hereby disclose apparatus for accomplishing an even yet adaptable spray of high-boiling, nonionic solvent-based dye compositions to fabric in open width while it is maintained in a non-reactive environment, and which allows changes to be made in the internal components of the apparatus without discontinuing production and purging or otherwise evacuating the contents of the equipment to allow workmen to enter the equipment and adjust or repair the problem.

SUMMARY OF THE INVENTION

Our invention includes a fluid nozzle assembly for dispensing fluid within the interior of a substantially closed structure. The assembly includes an elongated, rotatable housing provided along its length with a relatively narrow slot. This housing is mounted within a wall of the closed structure. An elongated manifold is provided with at least one dispensing nozzle, and this manifold is removably mounted within the housing for rotation with the housing. The elongated manifold has at least one dispensing nozzle aligned with the narrow slot so that in use, fluid dispensed from the nozzle passes through the slot and out of the housing. The housing and manifold are rotatable from a first operative position, where the dispensing nozzle or nozzles are in communication with the interior of the structure, to a second inoperative position where the dispensing nozzle or nozzles are substantially isolated from the interior of the structure.

Our invention also includes an apparatus for continuously dyeing fabric including fabric feed means; an enclosed, inert atmosphere tenter provided with liquid dyeing and heatsetting means in it; vacuum extractor means; solvent scouring means; drying means; and fabric take-up means. The invention is characterized by a fluid nozzle dispensing assembly associated with an exterior wall of the enclosed tenter for applying liquid dye to said fabric. The fluid nozzle dispensing assembly includes an elongated, rotatable housing provided along its length with a relatively narrow slot, the housing mounted within an exterior wall of the enclosed tenter. The housing and manifold are rotatable from a first operative position, in which the nozzle is in communication with the interior of the tenter, to a second inoperative position in which the nozzle is isolated from the interior of the tenter.

The fluid nozzle assemblies allow for the application of solvent-based dye dispersions with a facility to timely change color, width and/or amount of dye composition applied to the fabric (usually expressed as wet pick-up) without releasing excessive quantities of the inert atmosphere surrounding the textile fabric or otherwise interfering with the operation of the equipment. Dyeing equipment of this type is generally called a range, and includes a source of fabric to be dyed, a take-up box, means to apply the dye-containing composition to the fabric, a tenter frame maintained under inert conditions to fix the dyestuff to the fabric followed by scouring equipment (usually solvent scouring), drying and mechanical wind-up. The fluid nozzle assembly, or plurality of fluid nozzle assemblies, may be provided in one of the major flat surfaces, conveniently the top wall, of the enclosed environment device which is usually a tenter oven. It is understood that the fluid nozzle assembly can also be mounted in the floor or side walls of the tenter oven. The assemblies are arranged to be accessible either from the top or from their ends, and to allow the operator to access the assemblies without discharging the costly inert atmosphere, unnecessarily disrupting (reducing) the operational temperature of the dyeing range, or reducing the fabric speed. Manifold removal and replacement allow the operator to adjust for different widths of fabric to be treated, to clean or replace defective nozzles, or to change the type of dispensing nozzle and thereby adjust the amount of dye composition that is applied to the fabric (adjust the wet pick-up). The ability of the operator to make these and other types of changes away from the processing equipment reduces the likelihood of the operator being exposed to high-temperatures or inert atmospheres used in this type of processing equipment, and permits the operator to gain first-hand knowledge of the nozzle condition to assess variant processing conditions and make necessary adjustments as well as to provide for adequate and complete nozzle cleaning.

BRIEF DESCRIPTION OF THE DRAWINGS

FIG. 1 is an elevated perspective view, partially broken away, of a spray manifold assembly forming part of the top of a tenter frame, oven or other closed environment textile processing device;

FIG. 2 is a cross-sectional view of a top-loading rotating chamber for receiving a spray manifold secured to the top of the oven or treatment device;

FIG. 3 shows the spray manifold in place in the arrangement of FIG. 2;

FIG. 4 is an end view of an end-loading arrangement for retaining a spray manifold in sealing relationship with the side walls of a tenter frame or oven. Two concentric tubular shapes are arranged and are in sealing engagement such that the inner concentric tube may be rotated to a sealing relationship or may expose a spray manifold to the opening in the outer concentric, as shown in FIG. 5;

FIG. 5 is a cross-sectional view of the spray manifold in the operating position of the embodiment of FIG. 4;

FIG. 6 is a perspective side view of another fluid nozzle manifold assembly of the end loading type, shown in outline position in a rotatable housing spraying the dyeing composition onto the fabric.

DETAILED DESCRIPTION OF THE DRAWINGS

Figure 7:
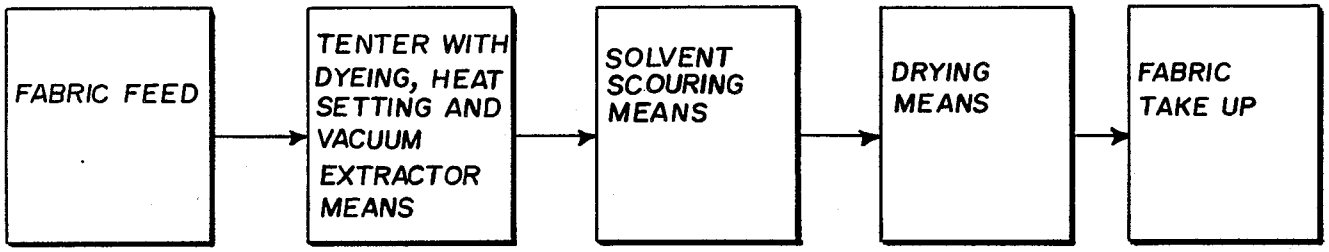
FIG. 7 is a schematic diagram illustrating an exemplary fabric dyeing apparatus including an improved fluid nozzle dispensing assembly in accordance with the invention.

Referring to FIG. 1, the fluid nozzle assembly 1 includes a rotatable housing 2 held in sealing relationship with the top wall surface of an enclosed environment textile treatment device 4 with a pair of resilient seals 6 on either side of the rotatable housing. A manifold 8 is concentrically positioned inside the rotatable housing 2, and is provided with a series of fluid nozzles or spray heads 10, which may be easily removable for cleaning or replacement with different size fluid nozzles along its length. The fluid nozzles, or spray heads, are aligned with a narrow opening or slot 12 provided on the housing 2, and issue the high-boiling, nonionic solvent-based dyeing composition onto the underlying fabric 14, and the amount of spray is preferrably adjusted so that little, if any, excess liquid is collected in a catch-pan 16 placed directly under the spray manifold. In FIG. 2, the rotatable housing 2 is in its inoperative or access position, opened at the top of the tenter frame or oven 4 for access to the spray manifold 8 (not shown in FIG. 2) In FIG. 3, the rotatable housing 2 is in its closed or operative position and issues the dyeing composition through the slot 12 and onto the underlying fabric 14 as in FIG. 1. In the embodiment illustrated in FIGS. 1–3, a pair of opposed resilient seals 6, made of materials such as rubber or synthetic rubber or other elastomer adapted to withstand the high temperatures, environment and pressures of a non-reactive, closed environment equipment, are provided to substantially isolate the housing and manifold from the interior of the oven structure when the housing is rotated to its inoperative position.

In FIGS. 4 and 5, another embodiment of the invention is shown in which an outer cylindrical housing 18 is in a fixed, non-rotating position and is mechanically secured or otherwise fastened, preferably between side walls of the tenter oven. Concentrically positioned inside the housing 18 is a smaller, rotatable cylindrical housing 20. Each housing is provided with an opening or slot 22, 24, respectively, which when in register in an operative position as illustrated in FIG. 5, permits liquid dye to be dispensed onto the underlying fabric 14.

In this embodiment, the spray manifold is loaded from one end of the outer housing 18 For this purpose, an end wall in the form of a door 36 provided with an annular seal 38 is hingedly mounted to the housing 18, although it could also be mounted directly on the tenter side wall.

The rotatable housing 20 in this embodiment includes a track or mounting device 26 for receiving a spray manifold 8 with its attached spray heads or fluid nozzles 10. Seals 28 are provided on either side of the opening of the larger, outer concentric fixed housing 18, and serve to seal or isolate the rotatable inner housing 20 from the interior of the oven when the two openings are not in register. It will be appreciated that during rotation in either embodiment, a quantity of the inert atmosphere may escape; however, the use of seals 28 and sealed door 36 ensures that the quantity that does escape is relatively small and can be well tolerated within normal processing conditions.

FIG. 6 shows the spray manifold assembly 8 with attached fluid nozzles 10 carefully positioned along the full width of the fabric 14 and issuing the dyeing composition in a generally uniform manner onto the underlying fabric. The embodiment depicted in FIG. 6 is of the end loading type in which an end wall in the form of a removable cap 30, (a hinged door as shown in FIG. 4 at 36 could also be used) is attached to one end of the cylinder and a quick disconnect fitting 32 is provided between the manifold 8 and the dye composition supply conduit 34. This arrangement may be employed where the spray manifold assembly is mounted in either the roof surface or side walls of the tenter oven. In operation, after the housing 20 is rotated to its inoperative position, as illustrated in FIG. 4, the removable end cap 30 is taken off, the quick disconnect fitting 32 disengaged and a spray manifold 8 together with appropriate fluid nozzles is removed for cleaning, replacement or other service or maintenance needs.

FIG. 7 is a schematic diagram illustrating, generally, a fabric dyeing apparatus for continuously dyeing fabric including fabric feed means, an enclosed inert atmosphere tenter provided with liquid dyeing means, heat-setting means, and vacuum extractor means. The apparatus also includes solvent scouring means, drying means and fabric take-up means. This apparatus preferably incorporates within the tenter, a fluid nozzle dispensing assembly as described hereinabove for applying liquid dye to the fabric.

Preferably, the tenter frame or closed atmospheric device is provided with several of these manifold arrangements. This allows the operator to direct the dyeing composition or compositions to one or several manifolds or to carefully preselect a given manifold for a given color dyeing composition. With such an arrangement, the dyeing composition color can be changed rapidly with little loss of unacceptable product when switching from one color to another. Also the arrangement allows for rapid access by the operator to adjust and repair defects in operation as they occur without stopping the equipment, sacrificing significant quantities or all of the inert atmosphere maintained in the device or exposing the operator to high temperatures and/or unhealthful conditions that occur inside of the equipment when it is being operated or shortly after operation is stopped.

What is claimed:

1. A fluid nozzle assembly for dispensing fluid within the interior of a substantially closed structure, said assembly comprising:

an elongated, rotatable housing provided along its length with a relatively narrow slot, said housing mounted in a wall of said structure;

an elongated manifold provided with at least one dispensing nozzle, said manifold removably mounted within said housing for rotation therewith, and said at least one dispensing nozzle aligned with said slot, so that in use, fluid dispensed from said nozzle passes through said slot and out of said housing;

said housing and said manifold rotatable from a first operative position wherein said at least one dispensing nozzle is in communication with said interior of said structure to a second inoperative position wherein said at least one dispensing nozzle is substantially isolated from said interior of said structure.

2. A fluid nozzle assembly as defined in claim 1 wherein said housing is cylindrical in shape and is rotatable about its longitudinal axis, said axis extending in a direction perpendicular to the direction of fabric travel.

3. A fluid nozzle assembly as defined in claim 2 wherein said manifold is radially removable from said rotatable housing through said slot when said rotatable housing is in said inoperative position.

4. A fluid nozzle assembly as defined in claim 3 wherein said wall is provided with means for sealingly engaging said rotatable housing during rotation thereof from said operative position to said inoperative position so that exposure of the interior of said structure to ambient atmosphere is minimized during removal of said manifold.

5. A fluid nozzle assembly as defined in claim 1 wherein said manifold is provided with a plurality of laterally spaced dispensing nozzles.

6. A fluid nozzle assembly as defined in claim 1 wherein said assembly includes a second substantially cylindrical, stationary housing secured to said wall and concentrically arranged with respect to said rotatable housing.

7. A fluid nozzle assembly as defined in claim 6 wherein said second housing is formed with a relatively narrow slot along the length thereof, said slot opening into the interior of said structure.

8. A fluid nozzle assembly as defined in claim 7 wherein the respective slots in said rotatable housing and said fixed housing are aligned when said rotatable housing is in said operative position, and diametrically opposite when said rotatable housing is in said inoperative position.

9. A fluid nozzle assembly as defined in claim 8 wherein said fixed housing is provided with means for sealingly engaging said rotatable housing as said rotatable housing rotates from said operative to said inoperative position.

10. A fluid assembly as defined in claim 9 wherein said manifold is slidably mounted in said rotatable housing and wherein said fixed housing is provided with a removable end wall, so that when said rotatable housing is in said inoperative position, said manifold is removable by axially sliding said manifold out of said rotatable housing and exposure of the interior of said structure to ambient atmosphere is minimized.

11. A fluid nozzle assembly as defined in claim 6 wherein said manifold is provided with a plurality of dispensing nozzles laterally spaced along its length.

12. In an apparatus for continuously dyeing fabric including fabric feed means; an enclosed, inert-atmosphere tenter provided with liquid dyeing and heatsetting means therein; vacuum extractor means; solvent scouring means; drying means; and fabric take-up means; the improvement comprising a fluid nozzle dispensing assembly associated with an exterior wall of said enclosed tenter for applying liquid dye to said fabric, said assembly including:

an elongated, rotatable housing provided along its length with a relatively narrow slot, said housing mounted within the said exterior wall of said enclosed tenter;

said housing and said manifold rotatable from a first operative position wherein said nozzle is in communication with said interior of said tenter to a second inoperative position wherein said nozzle is substantially isolated from the interior of said tenter.

13. Apparatus as defined in claim 12, wherein said housing is cylindrical in shape and is rotatable about its longitudinal axis, said axis lying within a plane formed by or parallel to the top wall of said tenter.

14. Apparatus as defined in claim 13, wherein said manifold is radially removable from said rotatable housing through said slot when said rotatable housing is in said inoperative position.

15. Apparatus as defined in claim 14, wherein said exterior wall is provided with means for sealingly engaging said rotatable housing during rotation thereof from said operative position to said inoperative position so that exposure of the interior of said tenter to ambient atmosphere is minimized during removal of said manifold.

16. Apparatus as defined in claim 12, wherein said manifold is provided with a plurality of laterally spaced dispensing nozzles.

17. Apparatus as defined in claim 12, wherein said assembly includes a second substantially cylindrical, stationary housing secured to said exterior wall and concentrically arranged with respect to said rotatable housing.

18. Apparatus as defined in claim 17, wherein said second housing is formed with a relatively narrow slot along the length thereof, said slot opening into the interior of said tenter.

19. Apparatus as defined in claim 18, wherein the respective slots in said rotatable housing and said fixed housing are aligned when said rotatable housing is in said operative position, and diametrically opposite when said rotatable housing is in said inoperative position.

20. Apparatus as defined in claim 19, wherein said fixed housing is provided with means for sealingly engaging said rotatable housing as said rotatable housing rotates from said operative to said inoperative position.

21. Apparatus as defined in claim 20, wherein said manifold is slidably mounted in said rotatable housing and wherein said fixed housing is provided with a removable end wall, so that when said rotatable housing is in said inoperative position, said manifold is removable by axially sliding said manifold out of said rotatable housing and exposure of the interior of said tenter to ambient atmosphere is minimized.

22. Apparatus as defined in claim 17, wherein said manifold is provided with a plurality of laterally spaced dispensing nozzles.

* * * * *